United States Patent [19]

Carter

[11] 4,101,095

[45] Jul. 18, 1978

[54] ADJUSTABLE AND EXPANDABLE SPOOL OR REEL ASSEMBLY

[75] Inventor: Clyde Thomas Carter, Shermans Dale, Pa.

[73] Assignee: AMP Incorporated, Harrisburg, Pa.

[21] Appl. No.: 809,741

[22] Filed: Jun. 24, 1977

[51] Int. Cl.[2] ..... B65H 75/22; B65H 75/14

[52] U.S. Cl. ..... 242/115; 242/71.9; 242/118.61

[58] Field of Search ..... 242/71.9, 71.8, 115, 242/118.62, 118.61, 118.7, 118.6, 118.4, 73, 77, 68.5

[56] References Cited

U.S. PATENT DOCUMENTS 2,610,811 9/1952 Moss ..... 242/118.61

2,881,985 4/1959 Overmire et al. ..... 242/71.8

FOREIGN PATENT DOCUMENTS 145,690 3/1952 Australia ..... 242/118.62

*Primary Examiner*—George F. Mautz

*Attorney, Agent, or Firm*—Russell J. Egan

[57] ABSTRACT

An improved expandable reel assembly is disclosed having a pair of mating hub members which allow ready assembly of the reel as well as adjustability for expansion of the width of the reel. The reel assembly includes a pair of sidewall members, a spacer member, and the mating pair of hub members which secure the sidewalls to the spacer member and accomplish both the spacing and locking of the reel assembly.

8 Claims, 3 Drawing Figures

ADJUSTABLE AND EXPANDABLE SPOOL OR REEL ASSEMBLY

BACKGROUND OF THE INVENTION

1. The Field Of The Invention

The present invention relates to an expandable reel assembly and in particular to an improved mating pair of hub members which readily adjust the reel for width and lockingly secures the assembly together.

2. The Prior Art

There are a good number of known reel assemblies which can be taken apart for storage or size adjustment. Examples of these known reel assemblies can be found in U.S. Pat. Nos. 1,013,588; 1,265,110; 1,679,573; 2,312,899; 2,695,142; 3,301,500; and 3,822,841. Most of the known assemblies have a number of specific disadvantages including both the number of parts required and the difficulty in actually disassembling and reassembling the reel. Also, many of the prior art devices cannot readily be adjusted in width to accommodate different sizes of stock on the assembled reel.

SUMMARY OF THE INVENTION

The subject expandable reel assembly includes a pair of sidewall members, a spacer member, and a pair of mating hub members which serve to lock the reel assembly together. The sidewall members are formed of rigid material and have an annular configuration. The spacer member likewise has an annular configuration and has a thickness approximating the desired width of the reel. The inner mating hub member has a central core extending from a base portion and received in a cylinder extending from a base portion of the outer hub member. Both base portions are adapted to engage a respective sidewall member and the base portion of the inner member includes keying portions matable with the central aperture of the spacer member. A series of interrupted radial bands are formed on the central core of the inner member. Interrupted inwardly directed flanges are likewise formed on the free end of the cylinder of the outer member. The central core of the inner member is received in the cylinder of the outer member and relative rotation therebetween causes engagement between the flanges and one band to lockingly secure the hub members together.

It is therefore an object of the present invention to produce an improved reel assembly which can readily be expanded to accommodate a wide range of stock material.

It is a further object of the present invention to produce an improved pair of mating hub members which can be readily employed with an expandable spool or reel assembly to adjust the spacing of the sidewalls thereof to accommodate different stock material.

It is a further object of the present invention to produce an improved expandable reel assembly which an be readily and economically produced.

The means for accomplishing the foregoing objects, and other advantages of the present invention, will become apparent to those skilled in the art from the following detailed description taken with reference to the accompanying drawings.

DETAILED DESCRIPTION OF THE PREFERRED EMBODIMENT

Figure 2:
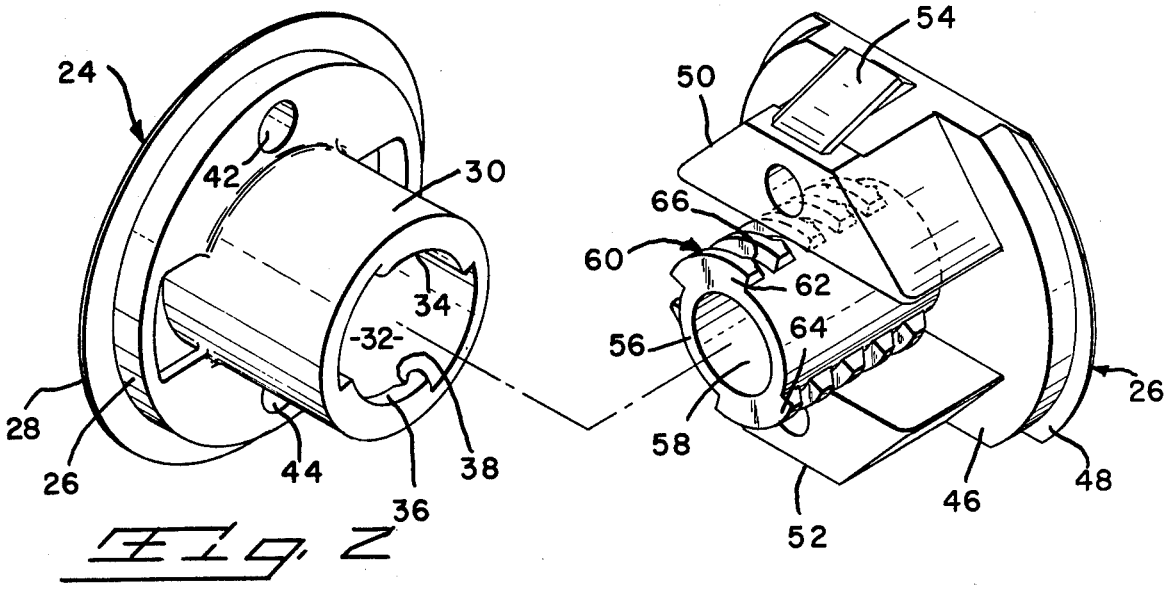
FIG. 2 is an enlarged view of the pair of mating hub members of the subject invention.
Figure 1:
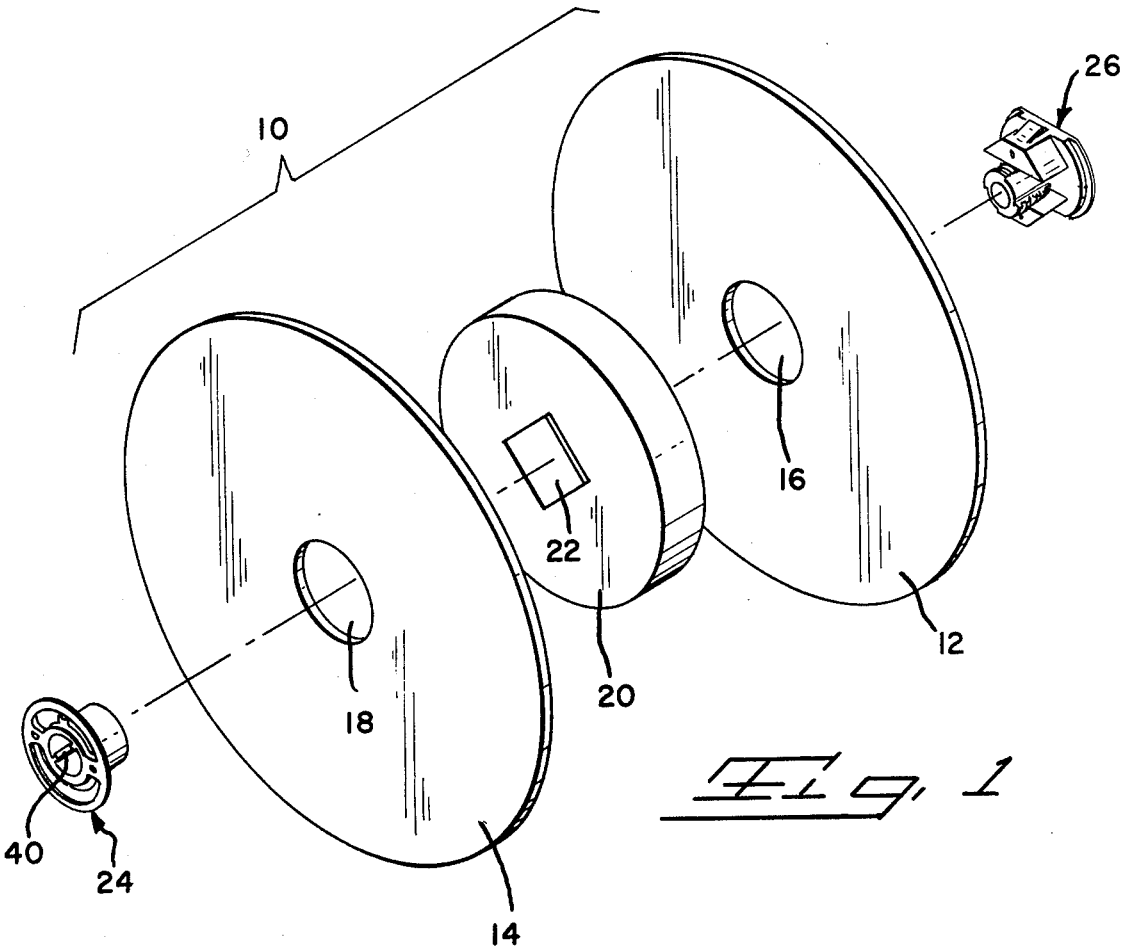
FIG. 1 is an exploded perspective view of the subject invention.

The subject reel or spool assembly 10 includes a pair of substantially identical sidewall members 12, 14 each having a respective central aperture 16, 18. The sidewall members are formed of any thin rigid material, such as metal or pressboard. A spacer member 20 is provided with a profiled central aperture 22. In this case the aperture 22 is a square, but any regular geometric figure, other than a circle, could likewise be used to key the spacer member to the hub. The spacer member can be made of any suitable material such as expanded polystyrene. The hub of the assembly is formed by a pair of interlocking hub members 24, 26. The outer hub member 24 has a circular base portion 26 which is profiled to be received in one of the apertures 16, 18 with a radially extending flange 28 engaging the respective sidewall member 12, 14. A cylindrical portion 30 extends coaxially from the base portion and has a through bore 32 and at least two profiled, inwardly radially extending flanges 34, 36 on the free end thereof. The flanges are each provided with a detent 38 on the rearwardly directed surface thereof. An abutment or stop flange 40 extends the length of the inner surface of the cylinder adjacent one end of one of the flanges 34, 36. The outer hub member 24 is also provided with at least two finger grip recesses or apertures 42, 44 in the base portion. The mating inner hub member 26 includes a base portion 46 having a radial flange 48 extending from one edge thereof. A pair of profiled keying portions 50, 52 extend from the base 46 and at least one of said keying portions includes a latching member 54 extending therefrom. The outer profile of keying portions 50, 52 together approximates the configuration of aperture 22 in spacer member 20. A substantially cylindrical locking portion 56 extends coaxially from the center of the base 46 and has a central aperture 58. A plurality of interrupted locking rings 60 are formed along the length of the locking portion 56. The locking rings 60 are here shown as pairs of arcuate flange members 62, 64 although clearly the rings can be divided into any convenient number. Each flange member includes a rearwardly directed detent 66. The hub members are preferably molded from plastics material having high rigidity and good wear characteristics. While only two flanges 34, 36 and 62, 64 have been shown, clearly any compatible number may be chosen with relative movement between the members determined accordingly.

The subject reel is assembled in the following manner. Sidewalls 12 and 14 of the appropriate diameter are selected together with a spacer 20 of the desired thickness. The sidewalls and spacer are secured together by the hub members 24, 26, which are essentially universal members for any reel size or thickness. The inner member 26 is inserted through the aperture 16 in sidewall 12 with the latching member 54 engaging the sidewall 12 to hold inner hub member 26 in this aperture. The spacer member 20 is then mounted on and aligned with the profiled keying portions of hub member 26 and held thereon by a friction fit. The cylindrical portion 30 of outer hub member 24 is inserted through aperture 18 in sidewall 14 and mated with the locking portion of inner hub member 26. The hub members are shown in FIG. 2 aligned as they would be in a locked condition. They would have to be rotated 90° relative to one another, from the position shown in FIG. 2, in order for the locking ring flange members 62, 64 to pass through the spaces between flanges 34, 36. The hub members are mated together until the desired flange members 62, 64 lie within the flanges 34, 36. The hub members are then rotated with respect to one another until the detents 66 engage in the recesses 38 to lockingly secure the hub members together. This rotation will also cause the flange members 62, 64 to lie against abutment 40 thus preventing further relative rotation of the hub members.

The present invention may be subject to many modifications and changes without departing from the spirit or essential characteristics of the invention. The present embodiment should therefore be considered in all respects as illustrative and not restrictive of the scope of the invention.

What is claimed is:

1. An expandable spool or reel assembly comprising:

a pair of rigid sidewall members each having a central aperture;

a spacer member having a profiled central aperture; and a mating pair of inner and outer hub members, each said hub member having a base portion receivable in a respective one of said apertures of said sidewalls and a radial flange adapted to engage the surrounding sidewall member, said outer hub member having a substantially cylindrical portion extending coaxially from said base portion, a bore through said cylinder, at least one inwardly directed arcuate flange at the free end thereof, and an abutment extending the length of said bore from one edge of said flange, said inner hub member having a substantially centrally located locking portion extending from said base with a plurality of interrupted rings on the outer surface thereof, each ring comprising at least one radially extending arcuate flange, and at least one keying member extending from said base portion and profiled for engagement in the central aperture of said spacer member, whereby said arcuate flanges of said inner member are passed between the arcuate flanges of the outer member and the hub members rotated relatively to bring said arcuate flanges into locking engagement.

2. An expandable spool or reel assembly according to claim 1 further comprising:

at least one detent on an inner rear surface of each said at least one inwardly directed arcuate flange at the free end of said cylindrical portion of said outer hub member, and at least one projection on a rear surface of each said radially extending arcuate flange of said inner hub member whereby said hub members are locked together by engagement of a projection in a detent.

3. An expandable spool or reel assembly according to claim 1 further comprising:

at least one latching member extending from at least one of said hub members to secure said hub member in a sidewall member .

4. An expandable spool or reel assembly according to claim 1 further comprising:

at least one finger grip hole in the base portion of at least one of said hub members.

5. A mating pair of hub members for joining together the sidewall members and spacer member of an expandable spool or reel assembly comprising:

an outer hub member having a base portion receivable in an aperture of a sidewall member and a radial flange adapted to engage the surrounding sidewall member, a substantially cylindrical portion extending coaxially from said base portion, a bore through said cylinder, at least one inwardly directed arcuate flange at the free end thereof and an abutment extending the length of said bore from one edge of said flange; and an inner hub member having a base portion receivable in an aperture of a sidewall member and a radial flange adapted to engage the surrounding sidewall member, said inner hub member having a substantially centrally located locking portion extending from said base with a plurality of interrupted rings on the outer surface thereof, each ring comprising at least one radially extending arcuate flange, and at least one keying member extending from said base portion and profiled for engagement in a central aperture of said spacer member;

whereby said hub members are joined by aligning the arcuate flanges on said inner member to pass between the flanges of the outer member and relatively rotating the members to bring the arcuate flanges into locking engagement.

6. A mating pair of hub members according to claim 5 further comprising:

at least one detent on an inner rear surface of each said at least one inwardly directed arcuate flange at the free end of said cylindrical portion of said outer hub member, and at least one projection on a rear surface of each said radially extending arcuate flange of said inner hub member whereby said hub members are latched together by engagement of a projection in a detent.

7. A mating pair of hub members according to claim 5 further comprising:

at least one latching member extending from at least one of said hub members to secure said member in a sidewall member.

8. A mating pair of hub members according to claim 5 further comprising:

at least one finger grip hole in the base portion of at least one of said hub members.

* * * * *

UNITED STATES PATENT OFFICE

CERTIFICATE OF CORRECTION

Patent No. 4,101,095 Dated July 18, 1978

Inventor(s) Clyde Thomas Carter

Figure 3:
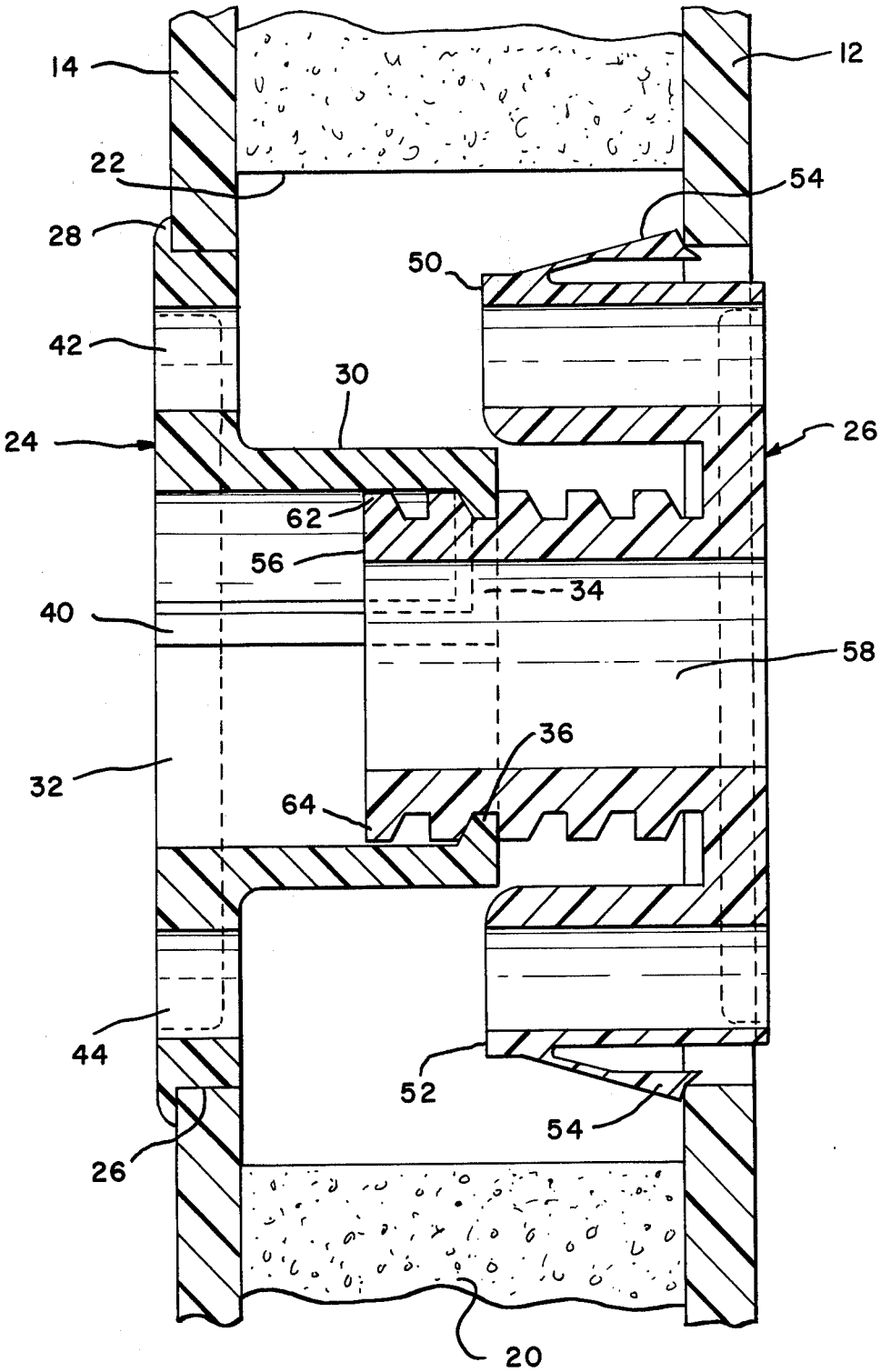
FIG. 3 is a section through the hub portion of the subject reel assembly in an assembled condition.

It is certified that error appears in the above-identified patent and that said Letters Patent are hereby corrected as shown below:

Figures 2 and 3 note the upper and lower bores in hub member 26 as --68-- and --70 -- respectively.

Column 2, line 54, after "accordingly." insert --The inner hub member 26 also includes at least two finger grip recesses or apertures 68, 70 in the keying portions 50, 52, respectively.--

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*